US010196236B2

(12) United States Patent
Sonnenmoser et al.

(10) Patent No.: US 10,196,236 B2
(45) Date of Patent: Feb. 5, 2019

(54) MONITORING SYSTEM OF AN ELEVATOR INSTALLATION THAT DETECTS USE DATA OF AN ELEVATOR DOOR

(71) Applicant: Inventio AG, Hergiswil NW (CH)

(72) Inventors: Astrid Sonnenmoser, Hochdorf (CH); Martin Kusserow, Lucerne (CH); Reto Tschuppert, Lucerne (CH)

(73) Assignee: INVENTIO AG, Hergiswil (CH)

( * ) Notice: Subject to any disclaimer, the term of this patent is extended or adjusted under 35 U.S.C. 154(b) by 408 days.

(21) Appl. No.: 14/911,768

(22) PCT Filed: Jul. 29, 2014

(86) PCT No.: PCT/EP2014/066274
§ 371 (c)(1),
(2) Date: Feb. 12, 2016

(87) PCT Pub. No.: WO2015/022185
PCT Pub. Date: Feb. 19, 2015

(65) Prior Publication Data

US 2016/0185569 A1 Jun. 30, 2016

(30) Foreign Application Priority Data

Aug. 13, 2013 (EP) ..... 13180168

(51) Int. Cl.
*B66B 1/34* (2006.01)
*B66B 5/00* (2006.01)

(52) U.S. Cl.
CPC ..... *B66B 5/0025* (2013.01); *B66B 5/0018* (2013.01)

(58) Field of Classification Search
CPC ..... B66B 5/0025; B66B 5/0018
USPC ..... 187/247, 277, 313, 314, 316, 317, 289, 187/391, 393
See application file for complete search history.

(56) References Cited

U.S. PATENT DOCUMENTS

| | | | | |
|---|---|---|---|---|
| 4,750,591 | A * | 6/1988 | Coste | B66B 5/0006 187/391 |
| 5,804,779 | A * | 9/1998 | Fargo | G05B 19/416 187/293 |
| 6,863,161 | B2 * | 3/2005 | Mearns | B66B 5/0006 187/247 |
| 7,073,633 | B2 * | 7/2006 | Weinberger | B66B 5/0025 187/247 |
| 7,423,398 | B2 * | 9/2008 | Tyni | B66B 5/0037 318/432 |

(Continued)

FOREIGN PATENT DOCUMENTS

| | | | |
|---|---|---|---|
| EP | 1849740 | A1 | 10/2007 |
| FR | 2955849 | A1 | 8/2011 |
| WO | 2004037700 | A1 | 5/2004 |

*Primary Examiner* — Anthony Salata
(74) *Attorney, Agent, or Firm* — William J. Clemens; Shumaker, Loop & Kendrick, LLP

(57) ABSTRACT

A monitoring system of an elevator installation having an elevator door and a method of operating the monitoring system are suitable for generating usage data of the elevator door, the monitoring system including a sensor arranged in the elevator installation, wherein at least one physical parameter of the environment of the sensor can be detected by the sensor, and an evaluating unit, which determines an operating state of the elevator door by a course of the physical parameter over time.

14 Claims, 2 Drawing Sheets

(56) References Cited

U.S. PATENT DOCUMENTS

| | | | | |
|---|---|---|---|---|
| 7,721,852 | B2 * | 5/2010 | Ishioka | B66B 7/08 187/313 |
| 7,823,706 | B2 * | 11/2010 | Tyni | B66B 5/0031 187/391 |
| 8,418,815 | B2 * | 4/2013 | Encinas Carreno | B66B 5/0006 187/247 |
| 8,540,057 | B2 * | 9/2013 | Schuster | B66B 1/34 187/247 |
| 8,653,982 | B2 * | 2/2014 | Yulkowski | E05F 15/40 340/540 |
| 8,678,143 | B2 * | 3/2014 | Bunter | B66B 5/0025 187/247 |
| 9,309,089 | B2 * | 4/2016 | Annen | B66B 5/0037 |
| 9,394,138 | B2 * | 7/2016 | Blanc | B66B 7/00 |
| 2003/0217894 | A1 | 11/2003 | Perala | |
| 2011/0067958 | A1 | 3/2011 | Schuster | |

* cited by examiner

MONITORING SYSTEM OF AN ELEVATOR INSTALLATION THAT DETECTS USE DATA OF AN ELEVATOR DOOR

FIELD

The invention relates to a monitoring system of an elevator installation and to a method for use of this monitoring system. The monitoring system serves for detection of use data of an elevator door.

BACKGROUND

Elevator installations comprise an elevator shaft and an elevator car movable in this elevator shaft. The elevator shaft is usually closed by shaft doors arranged at individual floors of a building. The elevator car has a car door which when located at one of the shaft doors is usually openable together with this shaft door.

Individual components of such an elevator door have a specific service life able to be assigned thereto. For example, guide shoes or guide rollers of the elevator door wear relatively rapidly. Towards the end of the mentioned service life, there is thus increased probability of occurrence of faulty functioning of the elevator door, which can cause temporary shutdown of the elevator installation. Through knowledge of the number of door opening and closing movements of the elevator door which have already taken place, thus the use data of the elevator door, it can be determined when faulty functioning of that kind of the elevator door is to be expected with a critically high level of probability. In order to avoid such faulty functioning, it is necessary to replace the aging components of the elevator door as far as possible in good time in correspondence with the specific service life thereof. Thereagainst, it is in the interests of operators of the elevator installation to utilize each individual one of the components of the elevator door in the sense of economy as long as possible, thus to preclude, in accordance with the use data of the elevator door, premature replacement by new components. Accordingly, monitoring of the use data of the elevator door is required in order to be able to selectively replace aging components.

These use data are usually able to be extracted from an elevator control acting on the elevator door. These use data cannot be extracted from many elevator controls of existing elevator installations due to, for example, the absence of interfaces or outdated modes of construction of the elevator controls. In addition, systems are known which, for example, comprise cameras and which can detect individual door leaf settings on the basis of differences in contrast. It is disadvantageous that systems of that kind give rise to high levels of cost due to their complexity.

It is therefore an object to offer an alternative device for generating use data.

SUMMARY

The object is fulfilled by a monitoring system of an elevator installation comprising an elevator door, wherein the monitoring system is suitable for providing use data of the elevator door, with a sensor arranged in an elevator installation, wherein at least one physical parameter of the environment of the sensor is detectable by means of the sensor, and an evaluating unit so constructed that an operating state of the elevator door can be ascertained by means of a time plot of the physical parameter.

The object is also fulfilled by a method of operating such a monitoring system, comprising the following method steps:

detecting a physical parameter of the environment of a sensor arranged in the elevator installation and determining an operating state of the elevator door by means of a time plot of the physical parameter.

The invention is based on the recognition that it can be recognized not only on the basis of changes which have taken place, but also on the basis of changes which have not taken place, for example the brightness or the magnetic field, in the vicinity of the elevator door whether the elevator door is opened or closed. On the basis of these data obtainable in a time plot it is possible to understand individual door leaf movements and accordingly to register and exploit the use data of the elevator door. On the other hand, an individual instantaneous value of the detected parameter would not be sufficient in order to be able to ascertain an operating state of the elevator door, because the course of the parameter over time during an individual operational state can be subject to strong fluctuations.

The physical parameter of the environment is thus given by the prevailing environmental conditions, i.e. this physical parameter is not influenced by the monitoring system. This is advantageous, since the monitoring system for this reason does not have any additional means which might influence the environmental condition and accordingly the system is advantageous.

In a development of the monitoring system the evaluating unit comprises a memory unit, wherein the evaluating unit is so constructed that at least one characterizing variable is determinable from the time plot of the parameter and this characterizing variable can be compared with at least one reference characterizing variable storable in the memory unit. The time plot of the parameter itself comprises a number of items of information such as, for example, a standard deviation, a mean value, a maximum deviation from this mean value or the duration of the door leaf movement. At least one of these items of information, considered over a defined period of time which is covered, forms such a characterizing variable. Comparison of this characterizing variable with the at least one reference characterizing variable makes possible a statement about the state of the monitored elevator door. Reference characterizing values of that kind can, for example, be ascertained during learning journeys or preset by standards.

The memory unit can be so constructed that specific use data, preferably a number of opening/closing processes and/or a duration of the opening/closing processes of the elevator door, are accumulated and stored for this elevator door. A memory unit constructed in that way and preferably fixed to a component of the elevator installation makes it possible for, for example, a service engineer to call up the use data on site at the elevator installation and to take appropriate measures. Such a measure is, for example, exchange of a component of the elevator door.

In a development of the monitoring system the evaluating unit is constructed in such a way that classification of the operating state of the elevator door is carried out by means of comparison of the characterizing variable with the reference characterizing variable. A simple possibility for a statistical capability of evaluation of the time plot is given in that way.

In a development of the monitoring system the sensor is so arranged in an environment of a shaft door or at a shaft door or one of the shaft doors that an operating state of the shaft door can be ascertained by means of a time plot, which is generated by the sensor, of the physical parameter. By means of such a fixing, monitoring of one of the shaft doors belonging to the elevator installation is made possible. The sensor can preferably be fixed to a door frame of the shaft door or to a part of the shaft door changing its position when an opening or closing movement of the shaft door takes place, for example the door leaf of the shaft door.

As an alternative to the aforesaid fixing of the sensor to the shaft door, the sensor can be fixed to or in an elevator car of the elevator installation. A car door and/or the shaft doors of the elevator installation can be monitored in that manner. If door leaf movements of any desired shaft door are processed together with an additional item of information, wherein the additional item of information precisely identifies the shaft door at which the elevator car is disposed at the instant of the registered door leaf movement, use data for each individual one of the shaft doors can be generated. This additional item of information can, for example, be extracted from the elevator control. Fixing of the sensor to or in the elevator car can be carried out so as to enable best-possible evaluation of the physical parameter to be detected. Detection of the light intensity by a sensor arranged within the elevator car leads to, for example, erroneous evaluation due to interior lighting, which is present in the elevator car and switchable independently of the door movement. In the case of an elevator shaft into which usually no light penetrates from outside when the shaft doors are closed and in the case of an elevator car with car outer surfaces impermeable to light, such erroneous evaluation of the light intensity due to interior lighting of the elevator car is not to be expected.

A development of the monitoring system comprises a car movement sensor, which is fixed to or in the elevator car and is preferably a speed or an acceleration sensor, for detecting a travel movement of the elevator car in an elevator shaft of the elevator installation, wherein the evaluating unit is so constructed that the operating state of the elevator door is counted as 'closed' independently of the time plot of the parameter when travel movement takes place. Characterizing variable values, which characterize different states of the elevator door, particularly 'opened elevator door' and 'closed elevator door', can be very difficult to distinguish from one another in certain circumstances. In the case of detected travel movement of the elevator car, due to safety precautions implemented in the elevator installation it can usually be assumed that the elevator doors are closed. Accordingly, an open setting or opening movement, which is detected by the monitoring system, of the monitored elevator door is disregarded when the elevator car travels in the elevator shaft. By means of such disregarding of a therefore obviously false evaluation of the time plot generated by the sensor the quality of the use data can thus be improved. Thereagainst, the door leaf movements are detected by the monitoring system when the elevator car is located at a shaft door.

In a development of the monitoring system the physical parameter is an optical parameter, preferably light intensity and/or color temperature. Accordingly, the sensor is constructed in such a way that at least one optical parameter is detectable by the sensor. Such a sensor can be selected as, for example, a sensor of the monitoring system when the elevator car is arranged in a completely walled elevator shaft. Accordingly, when the elevator doors are closed the sensor would be arranged in darkness all the time. Alternatively thereto, the physical parameter can be an acoustic parameter. Accordingly, the sensor is constructed in such a way that this acoustic parameter is detectable by the sensor. Such a sensor can be selected as, for example, a sensor of the monitoring system when the background noise around the elevator installation can be classified as quiet and consequently a door leaf movement can be acoustically audible with sufficient clarity. Accordingly, such a sensor which detects acoustics is suitable for dwellings.

In a further alternative the physical parameter is a magnetic parameter, wherein the elevator door comprises at least one part—preferably a door leaf and/or a guide carriage—which changes its position when opening or closing movement of the elevator door takes place and which is formed from magnetic material. A sensor registering magnetic parameters can be used as an alternative to a light-detecting or sound-detecting sensor in, for example, a department store which is characterized by a high noise level and the elevator shaft of which is bounded by light-permeable constructional material.

By means of these listed alternatives the physical parameter can be selected in such a way for each individual monitoring system to be installed that this selected parameter permits a clearest allocation of the individual states of the elevator door or doors to be monitored.

DESCRIPTION OF THE DRAWINGS

The invention is explained in more detail in the following by way of figures, in which.

DETAILED DESCRIPTION

Figure 1:
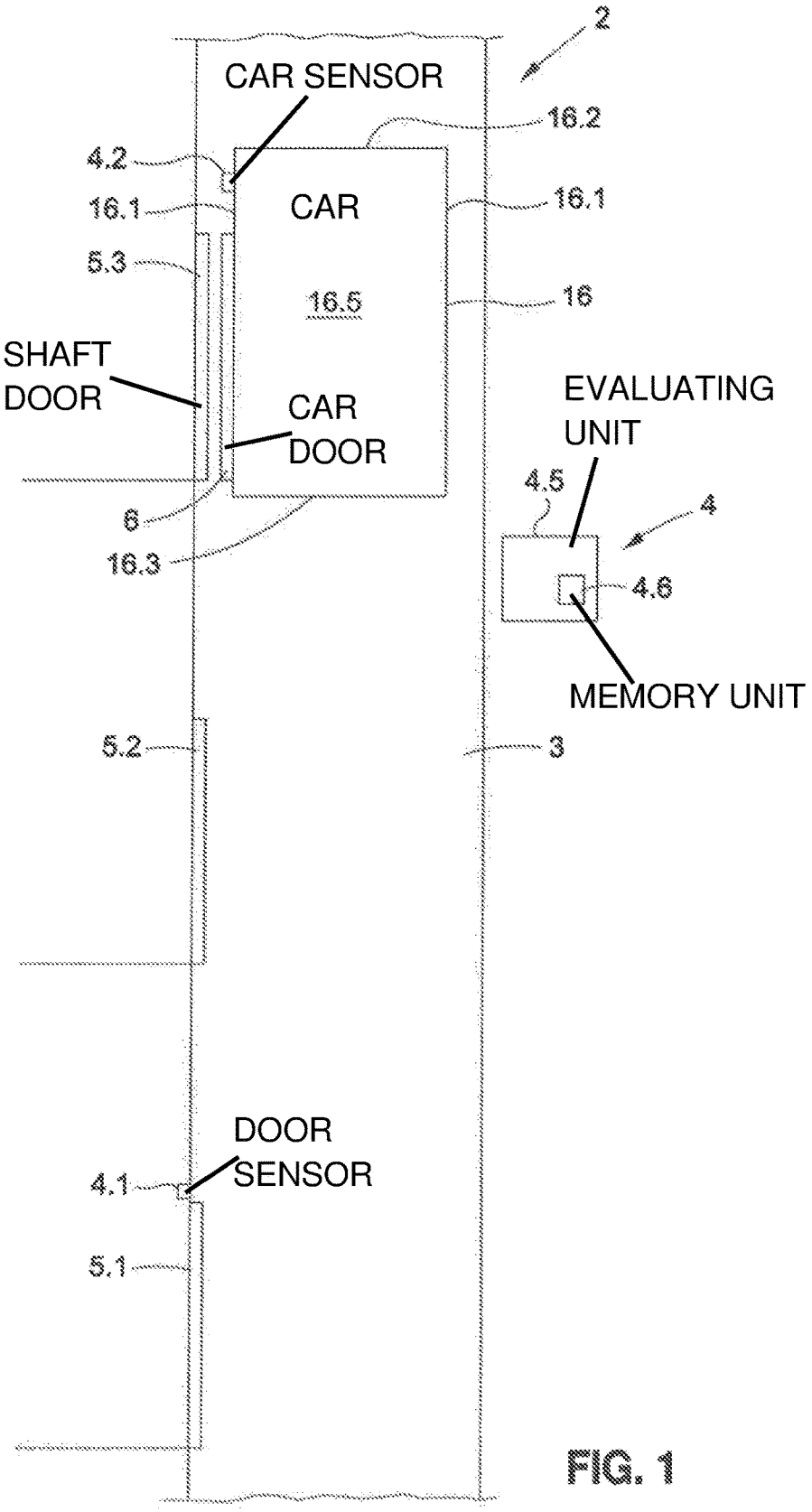
FIG. 1 shows an elevator installation with a monitoring system.

FIG. 1 shows an elevator installation 2. The elevator installation 2 comprises an elevator shaft 3 and an elevator car 16 movable in the elevator shaft 3. The elevator shaft 3 connects several floors. A shaft door 5.1, 5.2, 5.3 is arranged at each of these floors. The elevator car 16 has a car interior space 16.5, side walls 16.1, a car roof 16.2, a car floor 16.3 and a car door 6. The side walls 16.1, car roof 16.2, car floor 16.3 and car door 6 bound the car interior space 16.5. The elevator installation 2 comprises a monitoring system 4. A first car sensor 4.2 of this monitoring system 4 is fixed to or in the elevator car 16. A second shaft door sensor 4.1 of the monitoring system 4 is arranged at the shaft door 5.1. The at least one sensor 4.1, 4.2 detects a physical parameter of its environment such as, for example, a magnetic, an optical or an acoustic parameter.

The side walls 16.1, car roof 16.2 and car floor 16.3 are, for example, constructed to be impermeable to light in such a way that when the car door 6 is closed no light of the lighting system, which is usually arranged in the car interior space 16.5, penetrates into the elevator shaft 3. The car sensor 4.2 can detect not only an instantaneous light intensity acting on the car sensor 4.2, but also an instantaneous color temperature acting on the car sensor 4.2. Fixing of the car sensor 4.2 outside the car interior space 16.5 to one of the side walls 16.1 accordingly has the effect that changes of light in the car interior space 16.5 when the car door 6 is closed largely do not influence the car sensor 4.2. Particularly in the case of elevator installations having an elevator shaft 3 which is essentially dark when the shaft doors 5.1, 5.2, 5.3 are closed this means that an increased light intensity can be detected by the car sensor 4.2 substantially only when the car door 6 and/or the shaft door 5.3 arranged at the car door 6 are not closed. The opened shaft and/or car door 5.3, 6 can be ascertained in that way on the basis of the light intensity, which is detected by the car sensor 4.2, of its environment.

The car sensor 4.2 can equally be used, apart from detecting the use data of the car door 6, for detecting the use data of at least one of the shaft doors 5.1, 5.2, 5.3. This is so because during normal operation of the elevator installation 2 it can be assumed than when opening/closing of the car door 6 takes place one of the shaft doors 5.1, 5.2, 5.3 is coupled with the car door 6. Accordingly, the car door 6 is opened or closed simultaneously with the corresponding shaft door 5.1, 5.2, 5.3. Consequently, it is obvious that in the case of location of the elevator car 16 in accordance with FIG. 1, the shaft door 5.3 arranged at the top in the elevator shaft 3 is also opened at the time of opening of the car door 6. An item of information characterizing this shaft door 5.3, for example a floor identification, can be communicated to the monitoring system 4, for example by means of an elevator control of the elevator installation, so that door leaf movements of the actuated shaft door 5.3 can be assigned and accordingly use data relating to the actuated shaft door 5.3 can be processed or, if required, stored.

The shaft door sensor 4.1 is fixed with respect to the shaft door 5.1, for example to a door frame of the shaft door 5.1, in which case this shaft door sensor 4.1 detects the acoustics of its environment. When opening or closing of the shaft door 5.1 takes place a noise pattern corresponding with the closing or opening is audible, thus detectable. Accordingly, closings/openings of the shaft door 5.1 can be counted and thus use data of this shaft door 5.1 can be detected.

Alternatively thereto, the shaft door sensor 4.1 can be a magnetic sensor which detects magnetic conditions of its environment. A part of the shaft door 5.1 which changes its position in the case of closing/opening of the shaft door 5.1 is formed from magnetic material so as to enable detection of the opening or closing or the closed or open state of the shaft door 5.1 by the shaft door sensor 4.1 constructed as a magnetic sensor. The part changing its position when closing/opening of the shaft door 5.1 takes place can be, for example, a door leaf, a guide carriage or a section of a door drive belt of the shaft door 5.1.

Only one of the two sensors 4.1, 4.2 is required for detection of use data of at least one of the illustrated doors 5.1, 5.2, 5.3, 6. Equally, the monitoring system 4 can comprise sensors, which detect different physical parameters, for monitoring the same elevator door 5.1, 5.2, 5.3, 6 so as to enable, for example, an improved capability of evaluation of the time plots, which are generated by the different sensors, of the physical parameters.

Not only a car sensor 4.2, but also a shaft door sensor 4.1 of such a monitoring system 4 can be, for example, a light-detecting, noise-detecting or magnetism-detecting sensor. The selection of the appropriate sensor itself is dependent on, inter alia, how reliably the state, which is to be detected, acts on the sensor 4.1, 4.2 of the monitoring system by means of the parameter, which is to be detected, of the environment of the elevator door 5.1, 5.2, 5.3, 6.

The monitoring system 4 comprises, apart from the at least one sensor 4.1, 4.2, an evaluating unit 4.5. By means of this evaluating unit 4.5 a time plot, which is detected by the at least one sensor 4.1, 4.2, of the physical parameter can be assigned to a state of the monitored elevator door 5.1, 5.2, 5.3, 6. The use data able to be assigned to this recognized state can, for example, be communicated to a service engineer so as to enable maintenance of the elevator door 5.1, 5.2, 5.3, 6 concerned. This evaluating unit 4.5 can comprise a memory unit 4.6. At least one reference characterizing variable can be stored in the memory unit 4.6 and can be compared within the evaluating unit 4.5 with a characterizing variable derivable from the time plot of the physical parameter. The at least one reference characterizing variable can serve for classification of the individual operating states of the elevator door 5.1, 5.2, 5.3, 6.

The use data, which can be obtained by means of evaluation of the time plot of the physical parameter, of the elevator door can be stored in the memory unit 4.6, can be read out on site or can be communicated at a suitable point in time to a service engineer or to a service center.

Figure 2:
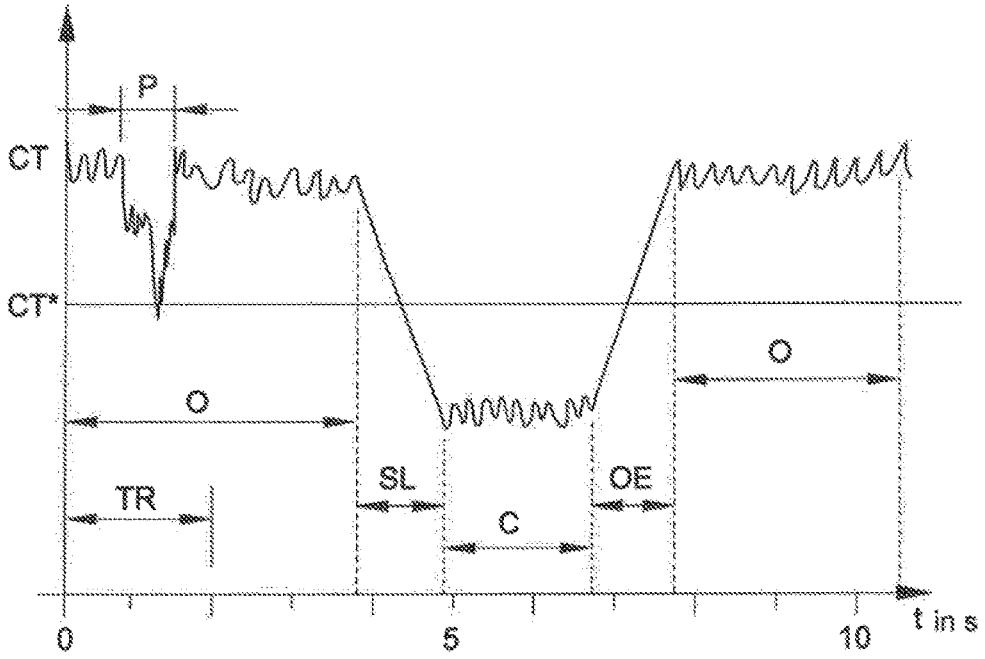
FIG. 2 shows a diagram illustrating a time plot of a physical parameter detected by the sensor of the monitoring system.

FIG. 2 shows a diagram in which the time plot of a physical parameter detected by the sensor of the monitoring system, for example the color temperature CT, is represented. This color temperature can be quantitatively determined by means of a color impression of the light sources acting on the sensor. From the illustrated plot of the color temperature CT is possible to recognize, by means of evaluation, operating states of the monitored elevator door: open setting O of the monitored elevator door, closing SL of the monitored elevator door, closed setting C of the monitored elevator door, and opening OE of the monitored elevator door. For this purpose, a characterizing variable applicable within a time period TR limited in terms of time, for example a mean value, can be derived from the time plot. This characterizing variable is compared with a reference characterizing variable, for example a reference value CT*, which enables classification of the stated operational states. Thereagainst, an individual instantaneous value of the physical parameter is not sufficient in order to be able to establish an operating state of the elevator door, because the course of the detected physical parameter is subject to substantial fluctuations.

Accordingly, for example, the actual duration of a door leaf movement can be compared with a reference duration of this door leaf movement. If, for example, the opening OE of the elevator door demands substantially more time than would be the normal case in accordance with the reference duration, it is in a given case possible to conclude faulty functioning of the elevator door, particularly of the door drive of the elevator door.

The mean value, which is detected in accordance with FIG. 2 in a time period TR, of the color temperature CT is greater than the reference value CT*, whereby the open setting O in the time period TR can be determined by the evaluating unit. This operating state is determinable independently of the individual instantaneous values, which can be smaller than the reference value CT* within the time period TR under consideration. Such instantaneous values can be caused by disturbances within a disturbance time period P. Objects which are transported within the elevator car and which influence the sensor can, for example, cause a disturbance of that kind.

In order to largely prevent determination of an operational state not corresponding with a setting of the elevator door, the reference value CT* can be adapted. In addition, other reference characterizing variables such as, for example, the standard deviation, can be included in the evaluation within the time period TR under consideration so as to be able to reliably ascertain the operational state. It can be postulated that in the case of, for example, excessive standard deviation the operational state ascertainable in accordance with the mean value does not influence the useful data of the elevator door.

Equally, the monitoring system 4 can comprise at least one sensor for monitoring the same elevator door 5.1, 5.2, 5.3, 6, wherein the sensor detects at least one physical parameter. In that way, different time plots, which are generated by the at least one sensor, of the physical parameter can be evaluated conjunctively in order to recognize, for example, the cause of occurrence of an above-mentioned disturbance.

Figure 3:
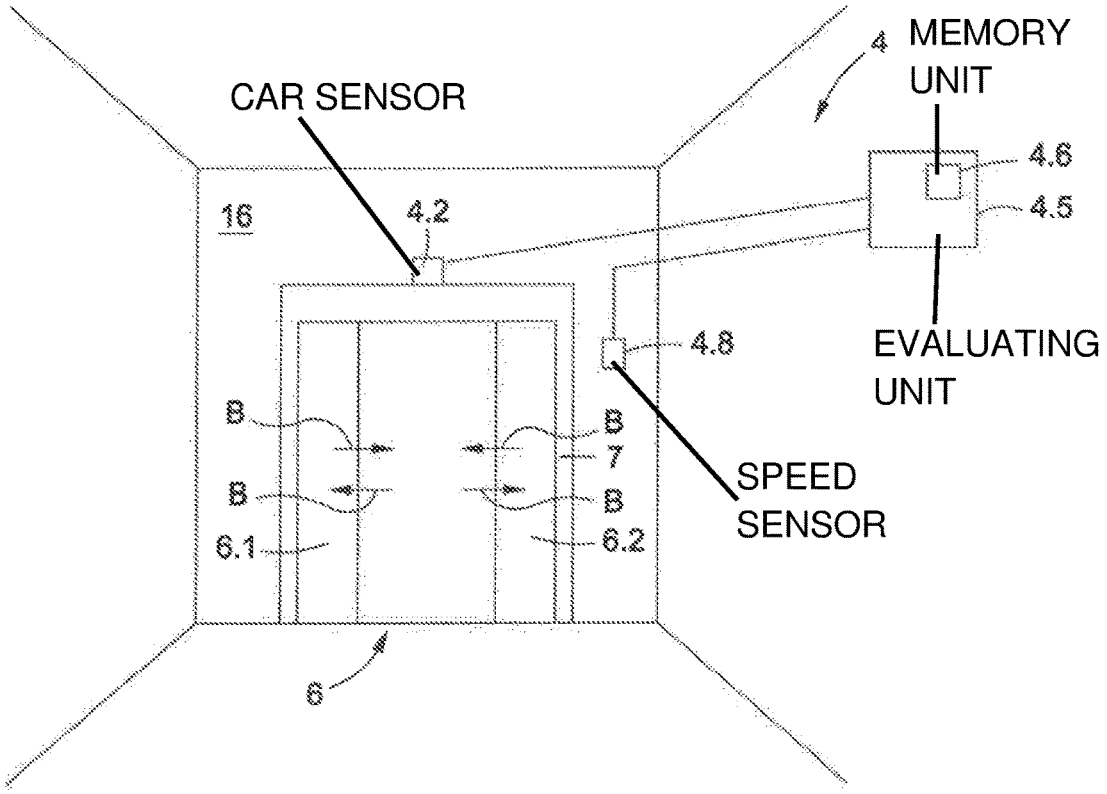
FIG. 3 shows a monitoring system of an elevator installation with a sensor arranged in the elevator car.

FIG. 3 shows an interior space of an elevator car 16 from the perspective of an elevator passenger. The elevator car 16 comprises a car door 6. The car door 6 has at least one door leaf 6.1, 6.2 for opening/closing the car door 6 and a door frame 7. The car door 6 can be opened or closed by means of a door leaf movement B of the door leaf 6.1, 6.2.

A monitoring system 4 comprises a sensor 4.2 and an evaluating unit 4.5, wherein the sensor 4.2 can, for the detection for creating the use data of the car door 6, be arranged in the environment of the door frame 7. The monitoring system 4 additionally comprises a speed sensor 4.8, which is arranged at or in the elevator car 16, for detecting a travel movement of the elevator car 16 taking place in the elevator shaft. The mentioned elements 4.2, 4.8 of the monitoring system 4 are preferably arranged in such a way that they are not visible to the elevator passengers.

It is detectable by means of the speed sensor 4.8 whether the elevator car 16 travels within the elevator shaft. When a travel movement is taking place, the car door 6 counts as closed regardless of whether or not evaluation of the time plot, which is generated by the car sensor 4.2, of the physical parameter suggests an expected closed setting of the car door 6. Accordingly, an obviously falsely detected open setting of the car door 6 can be disregarded and the accuracy, thus the quality of the use data, increased. It is necessary in certain circumstances not to evaluate slight vertical movements of the elevator car 16—which take place, for example, in the case of loading/unloading the elevator car 16 located at a shaft door—as such a travel movement.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A monitoring system of an elevator installation, the elevator installation having an elevator door, wherein the monitoring system generates use data of the elevator door, comprising:

a sensor arranged in the elevator installation for detecting at least one physical parameter of an environment of the sensor; and an evaluating unit responsive to the physical parameter for generating a time plot of the physical parameter and ascertaining an operating state of the elevator door from the time plot of the physical parameter, wherein the physical parameter is an optical parameter, wherein the evaluating unit includes a memory unit, wherein the evaluating unit determines at least one characterizing variable from the time plot of the optical parameter and compares the at least one characterizing variable with at least one reference characterizing variable stored in the memory unit, wherein the evaluating unit forms at least one item of information from a mean value, a standard deviation or a maximum deviation from the mean value derivable from the time plot, and wherein the characterizing variable is formed by the at least one item of information in a defined time period of the time plot.

2. The monitoring system according to claim 1 wherein the optical parameter is one of light intensity and color temperature.

3. The monitoring system according to claim 1 wherein the item of information is formed by the standard deviation and an excessive standard deviation is utilized such that the operating state, which is ascertainable in accordance with a mean value, of the elevator door does not influence the use data of the elevator door.

4. The monitoring system according to claim 1 wherein the operating state of the elevator door is formed by an open setting, a closed setting, a closing or an opening.

5. The monitoring system according to claim 1 wherein the reference characterizing variable is adaptable.

6. The monitoring system according to claim 1 wherein the reference characterizing variable is ascertainable during a learning travel of the elevator installation.

7. The monitoring system according to claim 1 wherein the memory unit accumulates and stores specific use data including at least one of a number of opening/closing movements of the elevator door and a duration of opening/closing movements of the elevator door.

8. The monitoring system according to claim 1 wherein the evaluating unit classifies the operating state of the elevator door by comparison of the characterizing variable with the reference characterizing variable.

9. The monitoring system according to claim 1 wherein the sensor is arranged in an environment of a shaft door wherein the operating state of the shaft door is ascertained from the time plot of the physical parameter generated by the sensor.

10. The monitoring system according to claim 1 wherein the sensor is fixed on or in an elevator car of the elevator installation.

11. The monitoring system according to claim 10 including a car movement sensor is fixed to or in the elevator car for detecting a travel movement of the elevator car in an elevator shaft of the elevator installation, wherein the evaluating unit is responsive to the car movement sensor for ascertaining the operating state of the elevator door as 'closed' regardless of the time plot of the physical parameter when the travel movement takes place.

12. The monitoring system according to claim 1 wherein the elevator door includes at least one door leaf that changes position when an opening or closing movement of the elevator door takes place and which is formed from magnetic material, wherein the physical parameter is a magnetic parameter.

13. The monitoring system according to claim 1 wherein the physical parameter is an acoustic parameter.

14. A method of operating a monitoring system for an elevator door in an elevator installation comprising the steps of:

detecting a physical parameter of an environment of a sensor arranged in the elevator installation;

generating a time plot of the physical parameter; and determining an operating state of the elevator door from the time plot of the physical parameter, wherein determining an operating parameter includes determining at least one characterizing variable from the time plot of the parameter and comparing the at least one characterizing variable with at least one reference characterizing variable, and wherein determining an operating parameter further includes forming at least one item of information from a mean value, a standard deviation or a maximum deviation from the mean value derivable from the time plot, wherein the characterizing variable is formed by the at least one item of information in a defined time period of the time plot.

* * * * *